US006347407B1

(12) United States Patent
Dowell

(10) Patent No.: US 6,347,407 B1
(45) Date of Patent: Feb. 19, 2002

(54) UNDERGARMENT FOR CONTROLLING UNDERARM PERSPIRATION

(75) Inventor: Brenda Diane Dowell, Oak Grove, LA (US)

(73) Assignee: Brenda Dowell, Knoxville, TN (US)

( * ) Notice: Subject to any disclaimer, the term of this patent is extended or adjusted under 35 U.S.C. 154(b) by 0 days.

(21) Appl. No.: 09/543,649

(22) Filed: Apr. 5, 2000

(51) Int. Cl.[7] ..... A41B 1/00
(52) U.S. Cl. ..... 2/113; 2/78.1
(58) Field of Search ..... 2/113, 69, 115, 2/106, 114, 53, 54, 55, 56, 267, 78.1

(56) References Cited

U.S. PATENT DOCUMENTS 3,474,465 A * 10/1969 Artzt ..... 2/113
3,508,279 A * 4/1970 Ayoub ..... 2/113

* cited by examiner

*Primary Examiner*—Gloria M. Hale

(57) ABSTRACT

This invention is an undergarment which helps control underarm perspiration and controls perspiration from soiling clothing and controls wetness from getting onto clothing from perspiration.

14 Claims, 2 Drawing Sheets

UNDERGARMENT FOR CONTROLLING UNDERARM PERSPIRATION

BACKGROUND OF THE INVENTION

The present invention is an undergarment to be worn underclothing to control underarm perspiration and control perspiration from wetting clothing.

A problem for many people is underarm perspiration and wetting and soiling of clothing under the arm. Sometimes a certain wearing apparel is not worn because it shows perspiration so badly. Articles of clothing are also soiled from perspiration and are therefore not wearable any longer. This invention will put all of this to an end.

SUMMARY OF INVENTION

The present invention is a perspiration controlling undergarment. It is to be worn under clothing to to control underarm perspiration and to prevent perspiration from wetting clothing. The undergarment is made of nylon for women and cotton for men. In the women'undergarment it would have a thin trim of lace on sleeve and possibly on bottom. The undergarment for women would have short sleeves and low neck line. The garment for women would have a double nylon lining (or cotton and nylon) under the underarm where a moisture absorbent material such as cotton. The men'undergarment would have short sleeves and would be made of cotton with a cotton double lining in which the moisture absorbent means would be sewn. The undergarment is washable. The undergarment would come in a variety of sizes such as S,M,L,XL,XXL, etc./and a variety of colors such as black, white, and nude colors.

BRIEF DESCRIPTION OF DRAWINGS

Referring to accompanying drawings of invention.

Figure 1A:
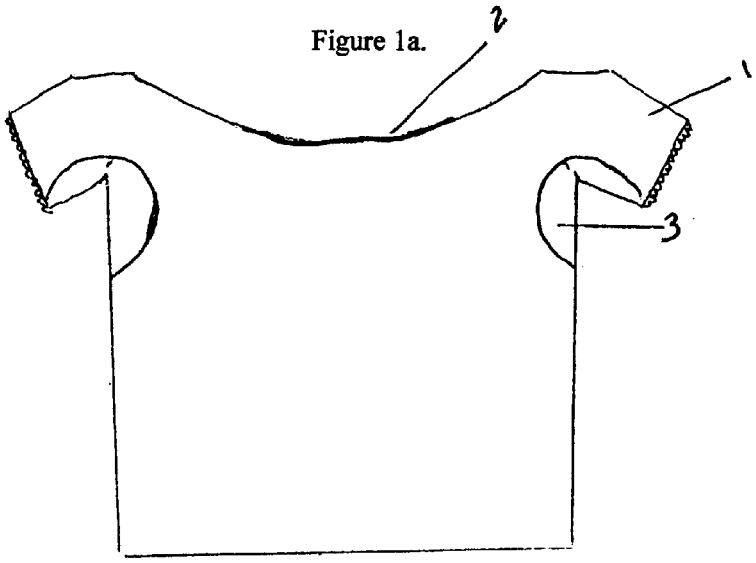
FIG. 1*a.* is a picture of the female undergarment. It shows the frontal view of undergarment with a very low neckline, very short sleeves, made of nylon except for moisture absorbent means, said undergarment extends form upper breast to lower stomach region. The back of garment is not pictured.

As referring to the drawings of the undergarment, FIGS. 1*a,* 1*b* shows a frontal view of the female article. It has short sleeves (1) and a low neck line (2). It would have a thin lace trim on sleeves possibly on bottom. The undergarment would extend from the upper breast to the lower stomach region. The undergarment would be made of nylon except for the absorbent means (3) and possibly the top layer of the double lining under the arm. There would be a double lining under the arm where a moisture absorbent means (3) would be sewn. The undergarment would come in a variety of colors and sizes. Article would be washable. The back would be the same as the front but the neck line would not be low.

Figure 1B:
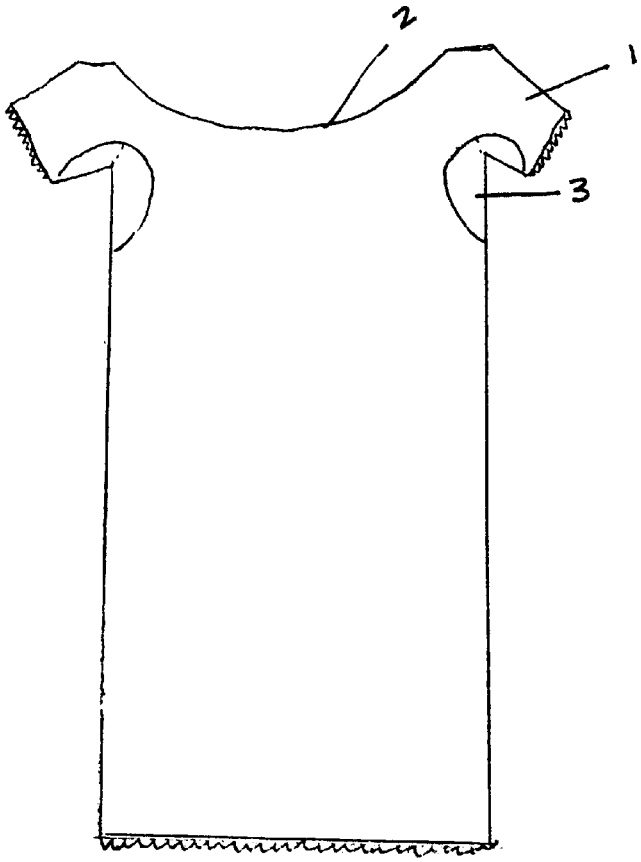
FIG. 1*b.* is a picture of female undergarment. It is the same as FIG. 1*a.* a frontal view, but it extends from upper breast to above knee for a longer garment with the moisture absorbent means.

As referring to the drawings of the undergarment, FIG. 1*b.* shows a frontal view of the female article. It has the short sleeves (1) with a low neck line (2). The undergarment is shown with a longer length. It extends from upper breast to above the knee, so it could be worn under a dress. It would have the moisture absorbent means under the arms. It would have lace trim on sleeves and bottom. The back is not pictured but would be the same as front but neck line would not be low.

Figure 2:
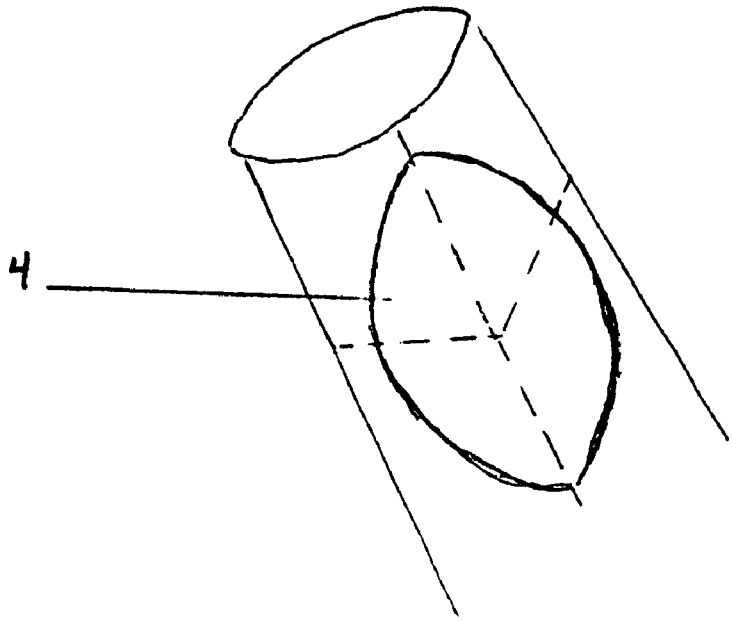
FIG. 2. is a picture of the sleeve with moisture absorbent pad. This is a picture of the underarm of the undergarment showing the absorbent pad.

As referring to the drawings of the under arm of the garment, FIG. 2. shows picture of the underarm of the garment There is a double lining (4) under the underarm of the garment which would include a sewn moisture absorbent means made up of a washable moisture absorbent material. The means would make up the whole area where perspiration would occur. The pad would be thin for comfort.

Figure 3:
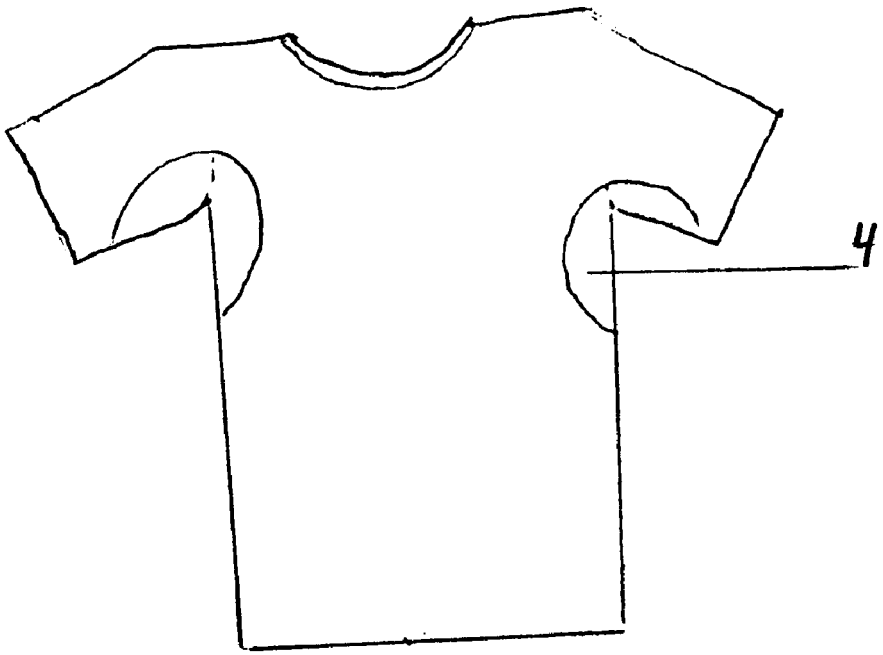
FIG. 3. is a picture of the undergarment for the male. It shows the frontal view of undergarment. The back of undergarment is not pictured. The undergarment would have short sleeves with moisture absorbent means, sewn in-between the lining of undergarment, made of a moisture absorbent material, which is thin for comfort and would be for absorbing perspiration and for preventing wetness from getting onto clothing.

As referring to the drawings of the undergarment , FIG. 3. shows a picture of the male garment. It would be made of cotton. It would have a double lining under the underarm where the moisture absorbent means would be sewn. It would not have as low as a neckline as the female undergarment and would extend from under neck to past waste. The back is not pictured.

What is claimed is:

1. An undergarment for absorbing a wearer's underarm perspiration in order to avoid the appearance of wetness and stains on a wearer's outer garment for a female comprising: an upper torso portion; two sleeves and a neckline; said sleeves attached to said torso portion to form a torso and sleeve underarm juncture area to cover the underarm area of a wearer; a two layer lining portion having a perimeter and attached along its perimeter to the garment torso; said lining portion adapted to cover the sleeve underarm juncture area corresponding to the area of the wearer which emits perspiration and to form a pocket wherein a moisture absorbent means is placed therein which absorbs the perspiration emitted from a wearer and thereby protecting a wearer's outer garment from perspiration wetness and stains.

2. A garment according to claim 1, in which said torso portion and said sleeves are sewn together with thread.

3. A garment according to claim 1, in which said fabric of said torso portion and sleeve is made of nylon, which is thin and fits loosely on body.

4. A garment according to claim 1, which said neckline is low and sleeves are very short.

5. A garment according to claim 1, wherein said torso portion comprises a length which extends from the upper breast to varying lengths from the lower stomach region to adjacent the knee of a wearer.

6. A garment according to claim 1, in which the moisture absorbent means are elongated to conform to curvature of the underarm junctures, and the fabric of said moisture absorbent means is closely knitted together.

7. A garment according to claim 1, in which said two layer lining portion extends from the end of sleeve down the side of bodice; and the moisture absorbent means is sewn into the two layer lining.

8. The method of making the garment comprises a substantially rectangular portion for the back and front body which laterally extends a portion for sleeves, and has a laterally centered low neck opening, the said front and back portion's seams are sewn together leaving bottom open, portion where sleeve is to be located open, and top where neck will protrude open; said sleeves extend laterally and are attached to said torso portion; extending from end of sleeve down the side of bodice is where the absorbent means is sewn on the underarm juncture area into a two layer lining; said two layer lining extends continuously and is sewn from the end of sleeve partly down the side of bodice.

9. The undergarment for absorbing a wearer's underarm perspiration in order to avoid the appearance of wetness and stains on a wearer's outer garment for a male comprising: an upper torso portion; two sleeves and a neckline; said sleeves attached to said torso portion to form a torso and sleeve underarm juncture area to cover the underarm area of a wearer; a two layer lining portion having a perimeter and attached along its perimeter to the garment torso; said lining portion adapted to cover the sleeve underarm juncture area corresponding to the area of the wearer which emits perspiration and to in order to form a pocket wherein a moisture absorbent means is placed therein which absorbs the perspiration emitted from a wearer and thereby protecting a wearer's outer garment from perspiration wetness and stains.

10. A garment according to claim 9, in which said torso portion and said sleeves are sewn together with thread.

11. A garment according to claim 9, in which said fabric of torso portion and sleeve is made of cotton.

12. A garment according to claim 9, in which the moisture absorbent means are elongated to conform to curvature of the underarm junctures and are closely knitted together.

13. A garment according to claim 9, in which said two layer lining portion extends from the end of sleeve down the side of bodice; and the moisture absorbent means is sewn into two layer lining.

14. The method of making the garment comprises a substantially rectangular portion for the back and front body which laterally extends a portion for sleeves, and has a laterally centered neck opening, the said front and back portion's seams are sewn together leaving bottom open, portion where sleeve is to be located open, and top where neck will protrude open; said sleeves extend laterally and are attached to said torso portion; extending from end of sleeve down the side of bodice is where the absorbent means is sewn on the underarm juncture area into a two layer lining, said two layer lining extends continuously and is sewn from the end of sleeve partly down the side of bodice.

* * * * *